US009381413B2

(12) United States Patent
Carroll et al.

(10) Patent No.: US 9,381,413 B2
(45) Date of Patent: Jul. 5, 2016

(54) GOLF TEE WITH RIGID STAKE AND FLEXIBLE CROWN

(75) Inventors: Francis Carroll, Philadelphia, PA (US); James Carroll, Jr., Richboro, PA (US)

(73) Assignee: GREENKEEPERS OF DELAWARE, LLC, Wilmington, DE (US)

( * ) Notice: Subject to any disclaimer, the term of this patent is extended or adjusted under 35 U.S.C. 154(b) by 0 days.

(21) Appl. No.: 12/018,387

(22) Filed: Jan. 23, 2008

(65) Prior Publication Data

US 2008/0182684 A1 Jul. 31, 2008

Related U.S. Application Data

(60) Provisional application No. 60/881,848, filed on Jan. 23, 2007.

(51) Int. Cl.
*A63B 57/10* (2015.01)

(52) U.S. Cl.
CPC ..... *A63B 57/10* (2015.10); *A63B 57/16* (2015.10); *A63B 2209/00* (2013.01)

(58) Field of Classification Search
CPC ..... A63B 57/0018; A63B 57/0043; A63B 2209/00; A63B 57/10; A63B 57/16
USPC ..... 473/387–403
See application file for complete search history.

(56) References Cited

U.S. PATENT DOCUMENTS

| | | | | | |
|---|---|---|---|---|---|
| 638,920 | A | * | 12/1899 | Grant | 473/396 |
| 1,551,207 | A | * | 8/1925 | Nial et al. | 473/400 |
| 1,554,321 | A | | 9/1925 | Banigan | |
| 1,573,911 | A | * | 2/1926 | Budrow | 473/396 |
| 1,588,038 | A | * | 6/1926 | Miller | 473/401 |
| 1,679,579 | A | * | 8/1928 | Lundy | 473/396 |
| D78,530 | S | | 5/1929 | McLeod | |
| 2,531,470 | A | * | 11/1950 | Rickard | 473/396 |
| D200,543 | S | | 3/1965 | Thomte | |
| 3,414,268 | A | * | 12/1968 | Chase | 473/396 |
| 3,633,919 | A | * | 1/1972 | Liccardello | 473/386 |
| 3,645,537 | A | * | 2/1972 | Parenteau | 473/396 |
| 5,372,362 | A | | 12/1994 | Barker | |
| 5,413,348 | A | | 5/1995 | Basso | |
| D369,845 | S | * | 5/1996 | Knez | D21/718 |
| 6,849,008 | B1 | * | 2/2005 | Wang | 473/401 |
| D516,146 | S | | 2/2006 | Iacono et al. | |

(Continued)

FOREIGN PATENT DOCUMENTS

| | | |
|---|---|---|
| EP | 1072291 | 1/2001 |
| JP | HEI 2-59955 | 6/1992 |

(Continued)

OTHER PUBLICATIONS

Advertisement for "Zero Friction Golf Tee," retrieved from www.zerofrictiontees.com on Aug. 28, 2008.

(Continued)

*Primary Examiner* — Steven Wong
(74) *Attorney, Agent, or Firm* — Blank Rome LLP; Michael C. Greenbaum; Tara L. Marcus

(57) ABSTRACT

A golf tee has a stake made of a rigid material such as a rigid polymer, combined with a flexible crown with flexible projections and possibly also a flexible pivot point. This reduces resistance at impact, producing less friction and low ball spin. As a result, distance and accuracy are improved. The fusion of the rigid and flexible materials provides a tee that can tolerate repeated hits and be used over and over.

13 Claims, 1 Drawing Sheet

(56) References Cited

U.S. PATENT DOCUMENTS

| | | | | |
|---|---|---|---|---|
| 7,011,586 | B2 * | 3/2006 | Toyosawa et al. | 473/401 |
| 7,090,594 | B2 * | 8/2006 | Kawashima et al. | 473/396 |
| 7,156,758 | B2 | 1/2007 | Lu | |
| D543,597 | S | 5/2007 | Lee et al. | |
| 7,344,456 | B2 * | 3/2008 | Hayton | 473/396 |
| D566,802 | S | 4/2008 | Carroll et al. | |
| 7,704,166 | B2 * | 4/2010 | Lim | 473/396 |
| 2002/0198066 | A1 * | 12/2002 | Salsman | 473/387 |
| 2004/0166964 | A1 | 8/2004 | Toyosawa et al. | |
| 2005/0003907 | A1 | 1/2005 | Ijiri | |
| 2005/0130769 | A1 | 6/2005 | Olsen | |
| 2005/0187041 | A1 * | 8/2005 | Kawashima et al. | 473/387 |
| 2006/0276269 | A1 | 12/2006 | Kihara | |
| 2007/0149324 | A1 * | 6/2007 | Tsai | 473/387 |
| 2007/0298910 | A1 * | 12/2007 | Potempa et al. | 473/401 |

FOREIGN PATENT DOCUMENTS

| | | | |
|---|---|---|---|
| JP | 04189374 | | 7/1992 |
| JP | 200519331 | | 1/2005 |
| JP | 2005021611 | A | 1/2005 |
| JP | 2005296330 | | 10/2005 |
| JP | 2006341016 | A | 12/2006 |
| KR | 20010099365 | | 11/2001 |
| WO | WO-2005/032668 | | 4/2005 |

OTHER PUBLICATIONS

Microfilmed Text of Japanese Utility Model Application No. SHO 47-117361 (Japanese Utility Model Public Disclosure No. SHO 49-73560) w/English translation.

* cited by examiner

GOLF TEE WITH RIGID STAKE AND FLEXIBLE CROWN

REFERENCE TO RELATED APPLICATIONS

The present Application claims the benefit of U.S. Provisional Patent Application No. 60/881,848, filed Jan. 23, 2007. Design aspects of the present invention are disclosed in U.S. Design patent application No. 29/271,594, filed Jan. 23, 2007. The disclosures of both of those applications are hereby incorporated by reference in their entireties into the present application.

FIELD OF THE INVENTION

The present invention is directed to a golf tee having a rigid stake and a flexible crown with flexible projections.

DESCRIPTION OF RELATED ART

Golf tees are typically made of a rigid material such as wood or hard plastic, with a cup-shaped crown for holding the golf ball. Since the cup causes too much friction, it would be desirable to reduce that friction.

The "Zero Friction Tee" has three hard plastic prongs. The friction is minimized because there are only three points of contact. However, the prongs do not flex.

Bristle-brush tees have bristles that flex, but they are not durable.

SUMMARY OF THE INVENTION

To overcome the above obstacles, the present invention is directed to a golf tee having a stake made of a rigid material such as a rigid polymer, combined with a flexible crown with flexible projections and possibly also a flexible pivot point. This reduces resistance at impact, producing less friction and low ball spin. As a result, distance and accuracy are improved. The fusion of the rigid and flexible materials provides a tee that can tolerate repeated bits and be used over and over.

BRIEF DESCRIPTION OF THE DRAWINGS

A preferred embodiment will be set forth in detail with reference to the drawings, in which.

DETAILED DESCRIPTION OF THE PREFERRED EMBODIMENT

Figure 1:
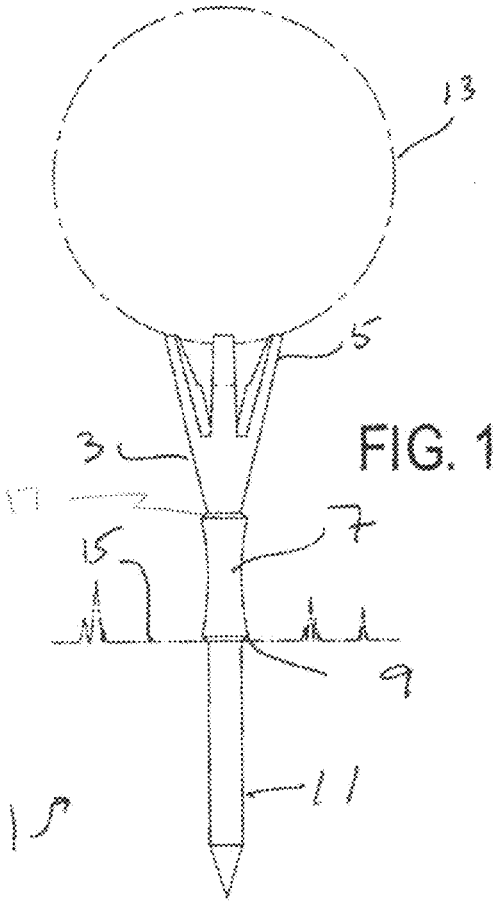
FIG. 1 shows a side view of the golf tee.

A preferred embodiment of the present invention will be set forth in detail with reference to the drawings, in which like reference numerals refer to like elements throughout.

As shown in the drawings, a golf tee 1 according to the preferred embodiment has a dynamic elastomer crown or head 3 with multiple projections 5, a flexible elastomer pivot point 7, a tee height indicator 9, and a rigid polymer stake 11. In use, the projections 5 support a golf ball 13, and the tee 1 is driven into the ground 15 up to the tee height indicator 9. While the preferred embodiment has six projections, another number of projections could be used.

Figure 2:
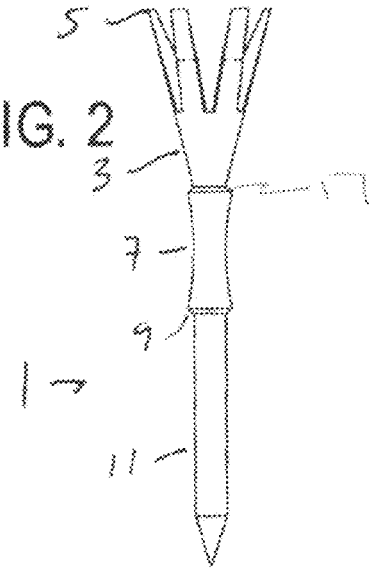
FIG. 2 shows another side view of the golf tee, out of the ground and with no golf ball.
Figure 3:
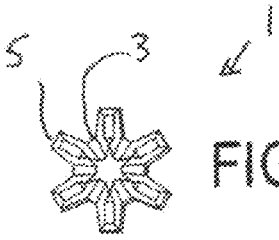
FIG. 3 shows a top view of the golf tee.
Figure 4:
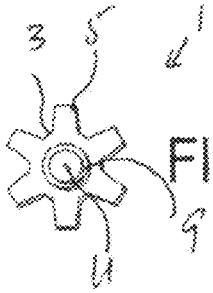
FIG. 4 shows a bottom view of the golf tee.
Figure 5:
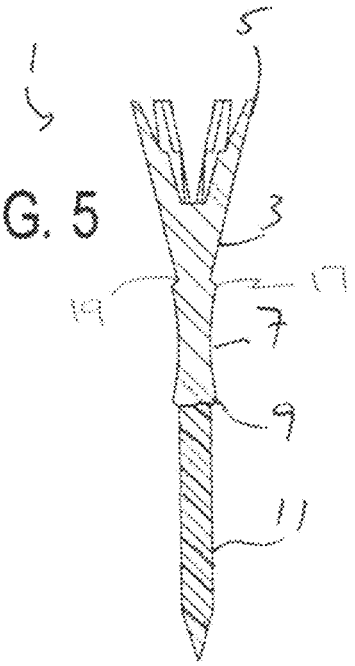
FIG. 5 shows a cross-sectional view of the golf tee.

As shown in FIG. 5, the crown 3 and pivot point 7 are made of a flexible elastomer such as LDPE or TPU. The sidewalls of the pivot point 7 may be concave. In a preferred embodiment, the sidewalls of the pivot point 7 are continuously concave from one end of the pivot point 7 to the other opposite end thereof, as seen in FIGS. 1 and 2. The crown 3 and pivot point 7 may form one-piece such that the end thereof at tee height indicator 9 abuts the stake 11 and no part of the stake 11 is received in the pivot point 7 or crown 3, as seen in FIG. 5. The stake 11 is made of a rigid polymer such as nylon or another hard plastic. Of course, other materials could be used. The bottom of the crown 3 tapers inwardly and meets an outwardly extending annular shoulder 17, as seen in FIGS. 1, 2 and 5. The radius of the annular shoulder 17 is greater than the radius of the bottom of the crown 3, thereby defining an annular recess 19 therebetween, as seen in FIG. 5.

The projections 5 are flexible, thereby producing lower friction than a conventional golf tee with a wooden cup or hard plastic prongs and a lower spin rate on the ball. Since the crown 3 is relatively harder than that of a prior art bristle-brush tee, the tee 1 can be pushed into the ground along with the ball 13 in a conventional manner. Another advantage relative to a bristle-brush tee is that the tee 1 of the preferred embodiment is longer lasting.

While a preferred embodiment of the present invention has been set forth in detail above, those skilled in the art who have reviewed the present disclosure will readily appreciate that other embodiments can be realized within the scope of the present invention. For example, numerical values and recitations of specific materials are illustrative rather than limiting. Therefore, the present invention should be construed as limited only by the appended claims.

We claim:

1. A golf tee comprising:

a crown having a plurality of flexible, elongated projections made of a first material for supporting a golf ball, the flexible, elongated projections having inner and outer surfaces that are outwardly angled;

a stake made of a second material which is less flexible than the first material; and a pivot point portion located between the crown and the stake, the pivot point portion having a first end that terminates at a bottom of the crown where the elongated projections are joined and an opposite second end, wherein the bottom of the crown tapers inwardly and meets an outwardly extending annular shoulder at the first end of the pivot point portion such that a radius of the annular shoulder is larger than a radius of the bottom of the crown.

2. The golf tee of claim 1, wherein the first material comprises an elastomer.

3. The golf tee of claim 2, wherein the second material comprises a rigid polymer.

4. The golf tee of claim 1, wherein the golf tee is integrally formed.

5. The golf tee of claim 1, wherein a portion of the crown adjacent to the projections has outer surfaces that are outwardly angled correspondingly to the outwardly angled outer surfaces of the projections.

6. The golf tee of claim 1, wherein the pivot point portion has sidewalls that are continuously concave from the first end of the pivot point portion to the second end.

7. A golf tee comprising:

a crown having a plurality of flexible, elongated projections for supporting a golf ball, the flexible, elongated projections having inner and outer surfaces that are outwardly angled;

a pivot point portion having a first end that terminates at a bottom of the crown, a second end opposite the first end, and sidewalls which are continuously curved from the first end of the pivot point portion to the second end thereof, the second end of the pivot point portion defining a tee height indicator, the crown and the pivot point portion being formed as one-piece of a first material; and a stake having an end abutting the second end of the pivot point portion wherein no part of the stake is received in the crown and the pivot point portion, the stake being made of a second material which is less flexible than the first material.

8. The golf tee of claim 1, wherein the crown and the pivot point portion are formed of one-piece.

9. The golf tee of claim 7, wherein the tee height indicator is wider than the stake.

10. The golf tee of claim 7, wherein the elongated projections are joined at the bottom of the crown.

11. The golf tee of claim 7, wherein the second end of the pivot point defines a tee height indicator.

12. The golf tee of claim 11, wherein the tee height indicator is wider than the stake.

13. A golf tee, comprising:

a crown having a plurality of flexible, elongated projections for supporting a golf ball, the flexible, elongated projections having inner and outer surfaces that are outwardly angled;

a pivot point portion having a first end terminating at a bottom of the crown, a second end opposite the first end, and sidewalls which are continuously curved from the first end of the pivot point portion to the second end thereof, the crown and the pivot point portion being formed as one-piece of a first material; and a stake having an end abutting the second end of the pivot point portion wherein no part of the stake is received in the crown and the pivot point portion, the stake being made of a second material which is less flexible than the first material, and wherein the bottom of the crown tapers inwardly and meets an outwardly extending annular shoulder at the first end of the pivot point portion such that a radius of the annular shoulder is larger than a radius of the bottom of the crown.

* * * * *